United States Patent [19]

Stern

[11] 3,932,966

[45] Jan. 20, 1976

[54] ABRASIVE DISC

[75] Inventor: Leif E. Stern, Uppakra, Sweden

[73] Assignee: Bill Peter Philip Nederman, Helsingborg, Sweden

[22] Filed: Mar. 25, 1975

[21] Appl. No.: 561,896

[30] Foreign Application Priority Data

Mar. 26, 1974 Sweden ..... 74040247
Sept. 17, 1974 Sweden ..... 74116674

[52] U.S. Cl. ..... 51/356; 51/170 MT
[51] Int. Cl.[2] ..... B24B 55/02; B24B 23/00
[58] Field of Search ..... 51/356, 358, 170 R, 170 T, 51/170 TL, 170 MT, 273, 275

[56] References Cited

UNITED STATES PATENTS 3,638,362 2/1972 Stoll ..... 51/170 MT
3,785,092 1/1974 Hutchins ..... 51/170 MT
3,788,011 1/1974 Hutchins ..... 51/170 MT
3,827,194 8/1974 Hutchins ..... 51/356

*Primary Examiner*—Othell M. Simpson
*Attorney, Agent, or Firm*—Bacon & Thomas

[57] ABSTRACT

An abrasive disc which may be attached to a holder having a suction device associated therewith. The disc includes a body of soft, resilient material and abrasive layers on both sides. Apertures, openings, and orifices in the abrasive layers and in the edge of the body allow air and particles to be drawn into internal passages in the body of the disc and flow out of the body to the suction device in the holder. The apertures also facilitate attachment of the abrasive disc to the holder.

11 Claims, 4 Drawing Figures

ABRASIVE DISC

BACKGROUND AND OBJECTS

1. Field of the Invention

The present invention relates to an abrasive disc which may be readily fixed on a holder. The disc is stabilized on the holder by means of pins projecting from the holder, and these pins also allow for easy removal of the disc from the holder. The abrasive disc is provided with apertures for sucking air up and grinding particles by means of a suction device.

2. Description of the Prior Art

Abrasive discs with apertures for sucking up air and grinding particles are expensive to produce, since the passages extending within said discs substantially complicate the process of manufacturing. Consequently, the discs are provided only with few passages, said discs are permanently secured on a holder and the grinding paper is exchanged in regular intervals. The grinding paper is fastened with a pressure sensitive glue, but the paper is easily unglued because of grinding particles becoming wedged in under the paper during operation.

OBJECTS OF THE INVENTION

It is an object of the present invention to provide a grinding device of the abovementioned type, which is inexpensive to produce despite a plurality of passages, which permits a stable fixing of grinding paper or the like, which permits easy mounting on the holder, stable fixing on said holder and quick demounting from the holder, and which allows for two opposed sides of the same to be used for grinding.

SUMMARY OF THE INVENTION

The foregoing difficulties in the prior art are overcome and the foregoing objects are achieved by providing an abrasive disc including a body of soft, resilient material having oppositely facing sides and an edge therebetween, a first abrasive layer and a first set of grooves on one side of the body, the abrasive layer extending across the grooves, a first set of openings in the edge, a first set of apertures in the first abrasive layer, the openings and apertures being connected with the grooves, whereby, in operation, air and particles may be drawn into openings and apertures, through the grooves and toward a suction device associated with the holder for the disc. According to more detailed aspects of the invention, there may be a second abrasive layer having a set of apertures on the other side of the disc, and second sets of openings and grooves. Either of the sets of apertures may be used in fastening the disc to its holder. In this regard, portions of the abrasive layer immediately adjacent the apertures are inwardly foldable in response to engagement with pins extending from the holder. These portions will abrasively engage the pins to secure the abrasive disc to the holder.

DRAWINGS

The invention will be further described below with reference to the accompanying drawings in which.

DESCRIPTION

Figure 2:
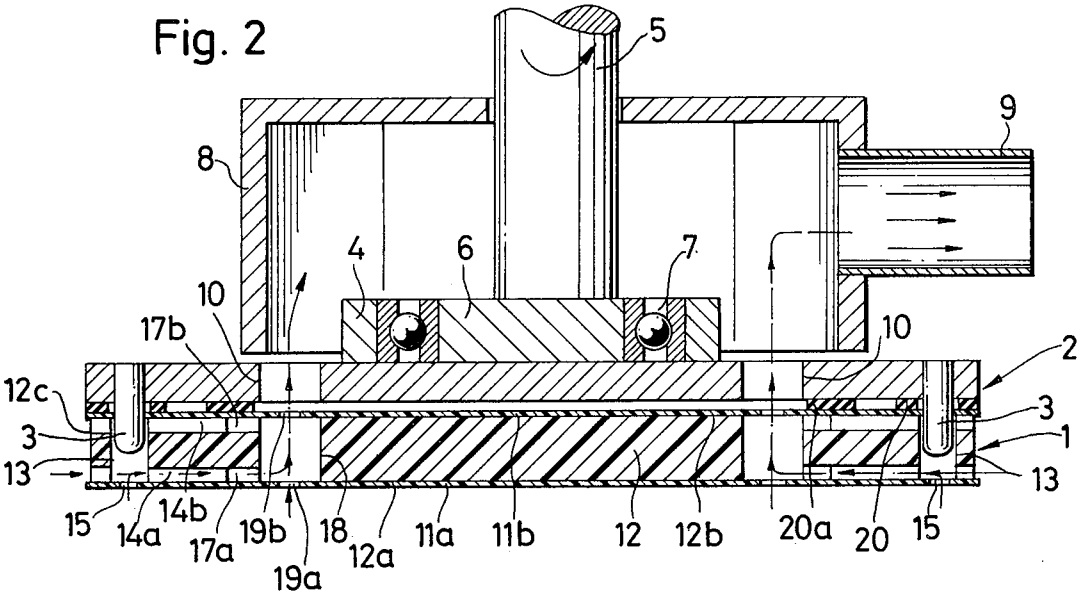
FIG. 2 is a section through the abrasive disc arranged on a holder.

The abrasive disc 1, which is to be described in more detail hereinafter, is designed to be arranged on a driven holder 2 and cooperate with a suction device (not shown). In FIG. 2, the holder 2 is in the form of a plate with projecting pins 3. The plate is supported by a ring 4 connected thereto, and is rotated and oscillated by means of a drive shaft 5 via an eccentric body 6 and a ball bearing 7. A housing 8 is placed above the plate of the holder 2, said housing having a connection piece 9 for connection to the suction device. When the abrasive disc 1 securedly securedly pressed on the plate 2, passages in the abrasive disc are communicating with the suction device via holes 10 in the plate 2, via the interior of the housing 8 and via the connection piece 9.

According to the invention, the abrasive disc 1 may easily be pressed on and attached to the holder 2 with any one of its opposed sides against the holder. After the pressing the abrasive disc 1 shall be fixedly secured on the holder and easy removable from the same, e.g. for being turned and pressed onto the holder with the abrasive for the grinding directed against the holder. Further, the abrasive disc must provide a stable securing of the abrasive, the abrasive disc shall be inexpensive to produce so that it may be thrown away after wearing out the abrasive and the abrasive disc must provide effective grinding particle collecting properties.

In order to accomplish this, the abrasive disc 1 according to the invention comprises a body 12 of a soft, resilient material, preferably expanded material, such as styrene. On two opposed sides 12*a*, 12*b*, an abrasive layer 11*a*, 11*b* is attached by, for example, glueing on each side respectively. The layers have greater density than the body 12. The opposed sides 12*a*, 12*b* of the body 12 are provided with grooves 14*a*, 14*b*. These grooves are covered by the abrasive layers respectively and to define passages which open against an edge 12*c* extending between the sides 12*a*, 12*b* of the body. Grooves 14*a* and 14*b* also open against the sides of the abrasive layers by means of apertures 15, 16 in said layers respectively and are connected to the suction device. The grooves 14*a* or 14*b* are placed beside each other at a distance somewhat exceeding the width of the grooves. This means that there are at least 32 air intakes provided in the preferred embodiment in the drawings.

If the pins 3 are sufficiently pointed (pointed pins not shown) they may be forced through the abrasive layers 11*a*, 11*b*, respectively and forced into the soft, resilient material of the body 12. Thus, the edges around every hole made by the pins 3 in the abrasive layers are bent inwardly so that the abrasive grains on each abrasive layer 11*a*, 11*b* engage the pins respectively. Consequently, displacement of the abrasive disc 1 on the pins 3 is effectively prevented, i.e. the abrasive is fixedly secured on the holder 2 during rotation and oscillation thereof. If desired, the abrasive disc is easily removable for turning or replacement with another disc, e.g. a disc having another size on the abrasive grains of the abrasive layer.

In order to provide a similar secure mounting of the abrasive disc 1 on the holder 2 and also to prevent disturbance of the air flowing in the disc, the body 12 is provided with holes 13 corresponding to the pins 3. The grooves 14*a*, 14*b* are connected to these holes 13 i.e. air flows streaming through the grooves must also pass through the holes 13. The pins 3 extend independently of the direction from which they are inserted in the holes 13 of the body 12, down through said holes 13 at least partially and preferably totally blocking the grooves 14*a* or 14*b* (14*b* in FIG. 2) under the abrasive layer 11*a* or 11*b* (11*b* in FIG. 2) lying closest to the holder 2 while leaving open the grooves 14*a* or 14*b* (14*a* in FIG. 2) under the abrasive layer 11*a* or 11*b* (11*a* in FIG. 2) turned away from the holder 2. Thus, the pattern of the air flow will be as follows see FIG. 2), Air is sucked in through apertures of the grooves 14*a* and openings in the edge 12*c*, passes the apertures 15, and through these taking up grinding particles, passes the annular channel 17*a* of two annular channels 17*a*, 17*b* extending in the opposed sides of the body 12, passes bores 18 and thereby (and/or when passing the annular channel 17*a*) passing orifices 19*a* in the abrasive layer 11*a* and through these orifices 19*a* taking up grinding particles. The air flow thereafter passes through the bores 18, without disturbance from air entering through the grooves 14*b*. The air also flows via orifices 119*a* in the abrasive layer 11*b* to the holes 10 in the holder 2 and, via these holes 10, to the interior of the housing 8 and the connection piece 9 to the suction device.

Figure 3:
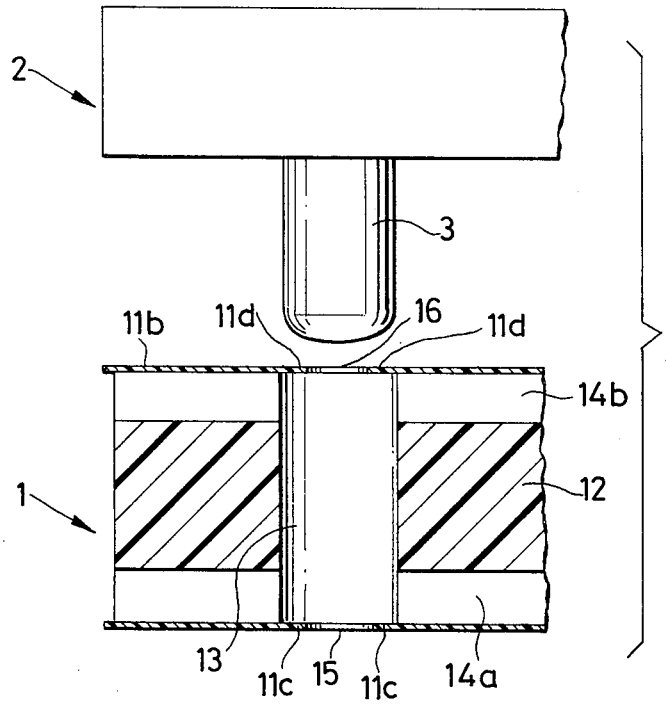
FIG. 3 is a section through a portion of the abrasive disc before it is mounted on the holder and finally.
Figure 4:
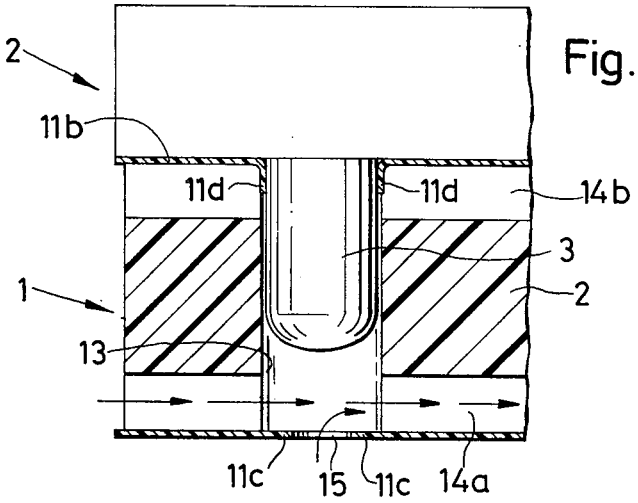
FIG. 4 is a section through said portion of the abrasive disc after its mounting on the holder.

In order to ensure substantial adherence between the abrasive disc 1 and the holder 2, the apertures 15, 16 in the abrasive layers 11*a*, 11*b* may be considerably less in size than the holes 13 beyond said apertures 15, 16. This means that the portions 11*c*, 11*d* overlapping the holes 13 in the body 12 are folded into the holes 13 when the pins 3 are forced in through said holes (see FIGS. 3 and 4).

Accordingly the abrasive grains on the portions 11*d* (and when the disc is turned, the abrasive grains on the portions 11*c*) will define a friction lining in the holes 13 for the pins 3.

To eliminate the risk that the holes in the abrasive disc do not communicate with the holder 2, said holder may be provided with a ring 20 (e.g. of a rubber material) of which the inner edge 20*a* lies outside the orifices 19*a*, 19*b* (19*b* in FIG. 2) in the abrasive layers 11*a*, 11*b* (11*b* in FIG. 2). This insures that a slit is formed between the disc 1 and the holder 2, through which slit air may flow obliquely, if necessary.

Figure 1:
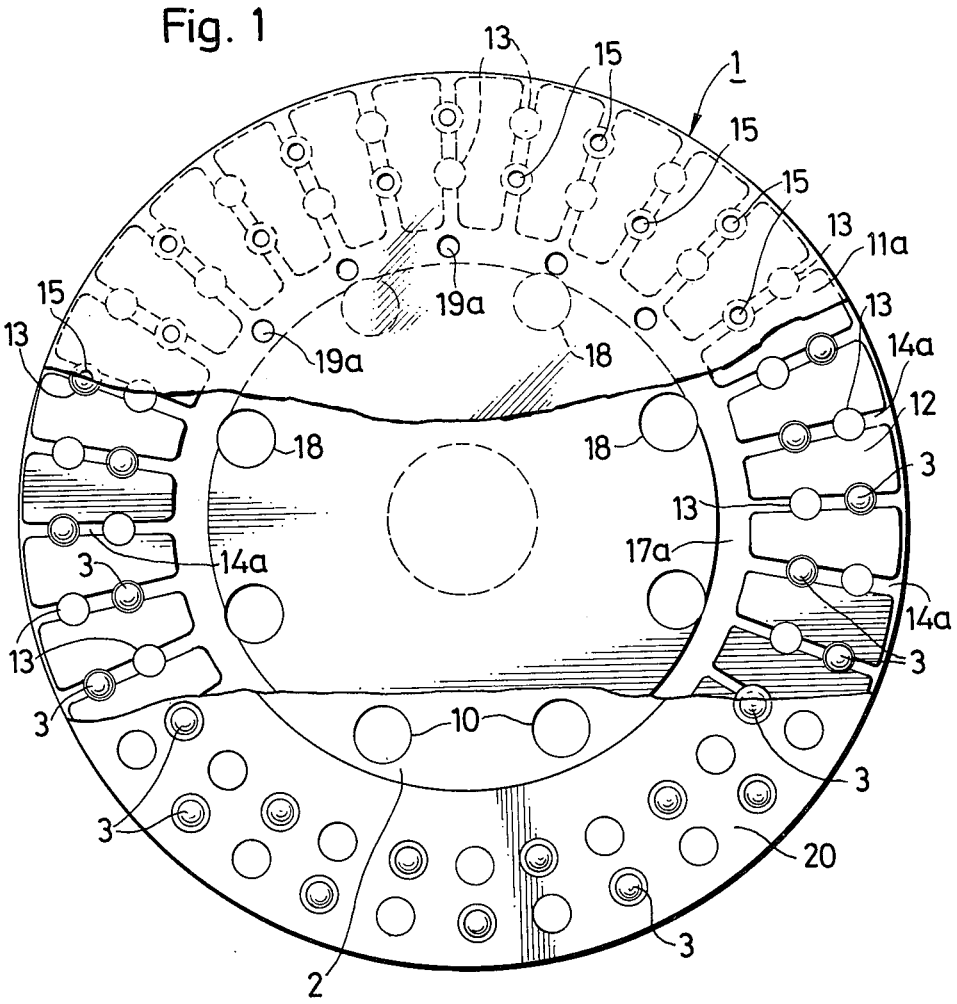
FIG. 1 shows the abrasive disc according to the invention from underneath and partly in section.

In order to create, for example three rows of grinding particle intakes (15, 16, 19*a* in FIG. 1) in each abrasive layer, the pins 3 may be arranged in two rows, whereby the pins 3 in one row are laterally displaced in relation to the pins 3 in the other row.

When describing the preferred embodiment, certain alternatives have been referred to. However, it is possible to define other sub-assemblies not mentioned here but within the scope of the present invention. For example the pins 3 may be hollow and define percolation passages.

I claim:

1. An abrasive disc which has an interior through which air and particles may flow and which is adapted to be detachably secured to a holder having pins projecting therefrom and a suction device associated therewith, the abrasive disc comprising:

a. a body of soft, resilient material having oppositely facing sides and an edge therebetween;
b. a first abrasive layer on one side of said body;
c. a first set of grooves in said body on at least said one side thereof, said abrasive layer extending across said grooves;
d. a first set of openings in said edge;
e. a first set of apertures in said first abrasive layer, said openings and said apertures being connected with said grooves;
f. whereby, in operation, air and particles may be drawn into said apertures and openings, through said grooves, and toward the suction device.

2. An abrasive disc as defined in claim 1 including:
a. a second abrasive layer on the other side of said body;
b. a second set of grooves in said body on said other side thereof, said second abrasive layer extending across said second set of grooves;
c. a second set of openings in said edge;
d. a second set of apertures, said second set of apertures being formed in said second abrasive layer, said second set of openings and said second set of apertures being connected with said second set of grooves.

3. An abrasive disc as defined in claim 2 wherein said apertures are adapted for an interference fit with the pins of the holder, portions of the abrasive layer immediately adjacent said apertures being folded inwardly from the exterior of the abrasive disc around said apertures when the abrasive disc is attached to the holder, said inwardly folded portions being adapted to abrasively engage the pins of the holder to secure the abrasive disc to the holder.

4. An abrasive disc as defined in claim 2, including a plurality of holes in said body, said holes being adapted to receive the pins of the holder therein, each of said holes intersecting one groove of said first set of grooves and one groove of said second set of grooves, whereby, in operation, at least one said sets of grooves is open for communication with its associated set of openings and apertures even when the pins of the holder are inserted into said holes.

5. An abrasive ddisc as defined in claim 4, wherein each of said holes completely surrounds its associated groove at a particular location along each groove, whereby, in operation, the pins of the holder block the grooves of the other of said sets of grooves.

6. An abrasive disc as defined in claim 4, wherein said sets of apertures are aligned with said holes and are smaller in diameter than said holes.

7. An abrasive disc as defined in claim 6, wherein each abrasive layer includes a portion immediately surrounding each of said apertures, each portion being inwardly foldable into said holes in response to engagement of said apertures with the pins of the holder, each of said portions having abrasive material thereon for effecting a secure grip on the pins.

8. An abrasive disc as defined in claim 2:
a. including a plurality of bores for effecting communication between the interior of the abrasive disc and the suction device;
b. wherein the grooves of said sets of grooves extend radially in said body, the distance between two adjacent grooves exceeding the width of each groove;
c. including first and second annular channels in said body, said first annular channel being disposed on one side of said body, said second annular channel being disposed on the other side of said body, said first set of grooves being connected with said first annular channel, said second set of grooves being connected with said second annular channel;

d. said bores intersecting said annular channels;

e. first and second sets of orifices in said abrasive layers, said sets of orifices being disposed radially inwardly of said sets of apertures, said orifices of said first set being disposed in said first abrasive layer, said orifices of said second set being disposed in said second abrasive layer, said first set of orifices communicating with said first annular channel and said bores, said second set of orifices communicating with said second annular channel and said bores;

f. whereby, in operation, one of said sets of orifices allows air and particles to flow from the interior of said body to the suction device and the other set of orifices provides an additional inlet for air and particles to flow into the interior of said body.

9. An abrasive disc as defined in claim 8 including a ring engaging an outer surface of one abrasive layer said ring having an inner edge disposed radially outwardly of said orifices.

10. An abrasive disc as defined in claim 1, wherein said body comprises an expanded material.

11. An abrasive disc as defined in claim 10, wherein said expanded material is an expanded plastic material such as styrene.

* * * * *